US005679041A

United States Patent [19]

Sokol et al.

[11] Patent Number: 5,679,041

[45] Date of Patent: Oct. 21, 1997

[54] METAL MATRIX COMPOSITE AND PREFORM THEREFOR

[75] Inventors: Gerald Edward Sokol, Shelby Township; Bob Ross Powell, Birmingham, both of Mich.

[73] Assignee: General Motors Corporation, Detroit, Mich.

[21] Appl. No.: 570,737

[22] Filed: Dec. 11, 1995

Related U.S. Application Data

[63] Continuation of Ser. No. 314,739, Sep. 29, 1994, abandoned.

[51] Int. Cl.[6] ..... B32B 9/00

[52] U.S. Cl. ..... 442/59; 428/357; 428/606; 428/614

[58] Field of Search ..... 428/614, 615, 428/608, 609, 357, 358, 359, 360, 361, 606, 607, 224

[56] References Cited

U.S. PATENT DOCUMENTS

| | | | |
|---|---|---|---|
| 4,327,156 | 4/1982 | Dillon | 428/614 |
| 4,822,694 | 4/1989 | Randin | 428/314.4 |
| 4,830,932 | 5/1989 | Donomoto | 428/614 |
| 4,917,964 | 4/1990 | Moshier | 428/614 |
| 5,028,392 | 7/1991 | Lloyd | 428/614 |
| 5,108,964 | 4/1992 | Corbett | 428/614 |
| 5,130,209 | 7/1992 | Das | 48/614 |
| 5,217,815 | 6/1993 | Das | 428/614 |
| 5,427,853 | 6/1995 | Powell | 428/357 |

OTHER PUBLICATIONS

Howard H.D. Lee, "Validity of Using Mercury Porosimetry to Characterize the Pore Structures of Seramic Green Compacts", J.Am.Ceram. Soc. 73[8]2309–15 (1990).

David R. Clarke, "Interpenetrating Phase Composites", J.Am.Ceram. Soc., 75[4] 739–59 (1992).

Fred F. Lange et al, "Method for Processing Metal–Reinforced Ceramic Composites", J.Am.Ceram. Soc. 73[2]388–93 (1990).

Powell et al, U.S. Ser. No. 08/169,251 filed Dec. 20, 1993, "Reinforcement Preform, Method of Making Same and Reinforced Composite Made Therefrom".

*Primary Examiner*—Patrick Ryan

*Attorney, Agent, or Firm*—Lawrence B. Plant

[57] ABSTRACT

Heterogeneous metal matrix composite (MMC), and preform for making same. The MMC has two distinct interpenetrating metal-containing regions one of which is rich in reinforcement particles, and the other of which is devoid of reinforcement particles. The particle-free region pervades the composite in the form of a three-dimensional, open-cell reticulum of randomly oriented ligaments interconnecting a plurality of nodes and defining a plurality of interconnected interstitial cells of varying size. To make the MMC, a preform comprising an open cell foam substrate infiltrated with reinforcement particles is filled with the matrix metal. In one embodiment, the substrate is a fugitive polymer foam which is removed prior to filling the preform with metal. In another embodiment, the substrate is a metal foam which remains with the preform and the MMC after filling with metal.

8 Claims, 2 Drawing Sheets

METAL MATRIX COMPOSITE AND PREFORM THEREFOR

This is a continuation of application Ser. No. 08/314,739 filed on 29-Sep.-1994, now abandoned.

This invention relates to metal matrix composites and a preform for making same.

BACKGROUND OF THE INVENTION

It is well known in the art to improve the properties of light metals such as Al, Mg, etc. (i.e., the matrix metal) by dispersing a variety of filler particles (e.g., ceramics) throughout the metal. Common filler particles include carbon/graphite, alumina, glass, mica, silicon carbide, silicon nitride, wollastonite, potassium titanate fiber, aluminosilicate (e.g., Kaowool), zirconia, yttria, inter alia. Such enhanced metals are often referred to as "metal matrix composites" or MMCs. The filler particles (a.k.a. reinforcements) may be essentially equiaxed, or elongated (e.g., whiskers and fibers), and serve to improve one or more of the mechanical properties (e.g., strength, toughness, lubricity, friction, fatigue resistance, wear resistance, etc.) of the composite over the properties of the matrix metal alone. Popular elongated particles (hereafter, fibrils) typically have an aspect ratio (i.e., length divided by diameter) of between, about 3 to about 20, and may be as high as about 50. The lengths of the. fibrils vary from about 50 to about 500 microns, and their diameters are generally less than about 10 microns. Typically, the reinforcing particles will constitute about 3% by volume to about 30% by volume of the MMC if the particles are fibrils, but may constitute as much as 70% by volume when the fillers are small equiaxed particles.

It has been heretofore proposed to make MMCs by either one of two processes. In one process, the filler particles are simply mixed with the metal while molten, and the mixture cast into an appropriate mold for shaping the finished product. In the second process, a self-supporting, net shape (i.e., size and shape of the finished product or portion thereof) porous preform of the filler particles is first formed and then subsequently impregnated with the matrix metal by well known wicking or pressure filling techniques.

Heretofore, preforms have been made by vacuum casting, where a 5 v/o whisker/water slurry is drawn through a screen leaving behind a mat of whiskers which is further densified to 15–25 v/o by pressing. This process has a number of disadvantages. First, vacuum casting is limited to shapes with two-dimensional complexity, and dimensional control is poor (at best ±0.10 cm/cm). More complex shapes must be machined from vacuum cast blocks, but this adds cost to the process. Second, the whiskers in vacuum cast preforms are oriented in a random planar fashion, giving rise to planes of weakness in the preform. Third, inorganic binders such as colloidal silica must often be added to give the preform sufficient strength to withstand handling. These binders may become entrained in the MMC during infiltration and can have a detrimental effect on MMC properties if they cluster together.

Preforms have also been made by injecting a mixture of the filler particles and an organic binder into a suitable mold, removing the binder and then, optionally, bonding and the particles together into a self-supporting structure. One known such technique for making preforms comprises mixing the filler particles uniformly throughout a fugitive binder (e.g., wax, polystyrene, polyethylene, methyl cellulose/$H_2O$ gel, etc.), injecting the binder-particle mixture into a mold, and removing (e.g., burning out, volatizing or dissolving) the binder. In some cases (e.g., with certain materials, or with low particle loadings), it may be desirable to bond the particles together following binder removal and before impregnating them with metal. Particle bonding, if used, may be achieved (1) by sintering, (2) by initially providing the particles with a coating of colloidal silica or alumina which, upon heating, acts like a high temperature interparticle glue, or (3) by oxidizing the particles to hold them together. When SiC is used as the reinforcement, the SiC particles can be bonded together by heating the particles to above 600° C. in air to form $SiO_2$ in situ on the surfaces which they bond the particles each to others.

Another more recently developed technique for making preforms involves mixing the filler particles with certain prepolymers used to produce a fugitive open-cell foam such that the particles migrate to, and align themselves with, the ligaments formed in the resulting foam. This technique is described in more detail in U.S. Pat. No. 5,427,853 issued Jun. 27, 1995 to Powell et al and assigned to the assignee of the present invention.

After, the preform is made it is transferred to a metal-filling station where it is impregnated with the desired matrix metal (e.g., aluminum). Metal impregnation may be accomplished by evacuating air from the porous preform, contacting it with molten metal, and allowing the metal to settle or wick into the preform. In one such technique, the preform is laid atop a solid mass of the matrix metal, and together therewith, heated in flowing nitrogen to above the melting point of the metal until the metal wets the particles and wicks into the preform. Preferably, however, the metal will be forced into the preform under pressure (e.g., as by squeeze casting).

Preforms made heretofore tended to distort and lose their shape when heated to remove the binder. Moreover, a problem with preforms made by injection molding, is the time required for, cost of, and environmental considerations associated with, burning off of the large amounts of organic binder used therewith. Still further, preforms made heretofore tend to lack durability in that they are quite delicate and fragile, and accordingly can easily crack during handling and/or filling with metal. Regardless of these difficulties, the use of preforms is still considered by many to be the preferred way to make MMCs owing to the ability to incorporate higher whisker volume fractions than is possible by the direct casting of whiskers dispersed in the molten metal, and the ability to reinforce select areas of a casting without having to reinforce the entire casting. Accordingly, it would be desirable to provide a more durable preform that is easily made, retains its shape, and is resistent to cracking during handling and subsequent processing.

It is an object of the present invention to provide a unique, durable, heterogeneous MMC preform, and a unique heterogeneous MMC made therefrom, which MMC has two distinct interpenetrating metallic regions one of which is rich in filler particles and the other of which is devoid of filler particles.

This and other objects and advantages of the present invention will become more readily apparent from the following description thereof which is given hereafter in conjunction with certain examples and several figures in which.

THE INVENTION

Figure 1:
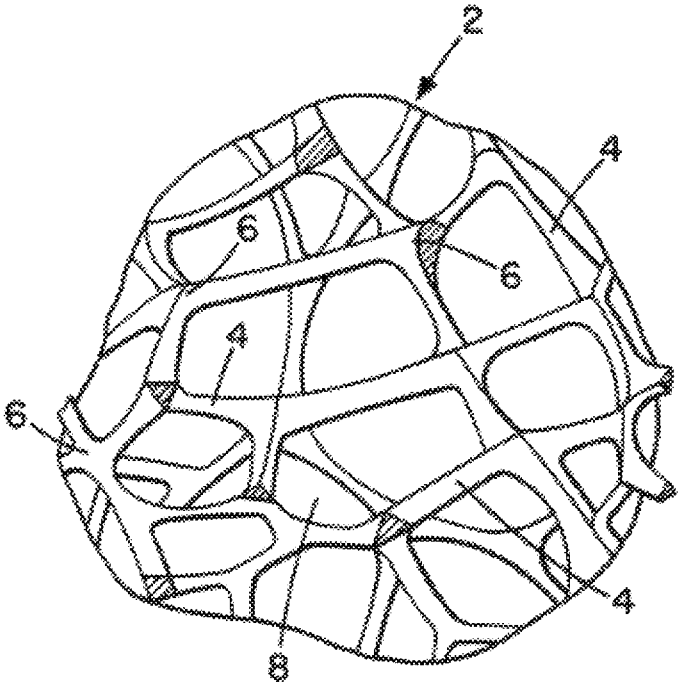
FIG. 1 is a draftsman's illustration of the structure of a three-dimensional, open-cell, foam substrate.

The present invention comprehends durable, filler preforms for making heterogeneous MMCs, and unique MMCs made therefrom which have good wear-resistance properties (i.e., comparable to conventional MMCs). As used hereinafter, the term MMC is intended to refer only to that portion of a finished casting where the preform resides. Thus if the preform extends throughout the entire casting, then the entire casting is considered to be the MMC for purposes of calculating the concentrations set forth herein. On the other hand, if only a localized portion of a casting (e.g., the top of a piston) contains the preform, and the remainder of the casting does not, then only the localized region of the casting where the preform resides is considered to be the MMC for purposes of calculating the concentrations set forth herein.

MMCs according to the present invention have two distinct interpenetrating metal-containing regions. One "particle-rich" region comprises about 60% to about 99% by volume of the MMC, and contains a multiplicity (i.e., ca. 5% to ca. 70% by volume) of discrete filler particles dispersed throughout the metal. The particles will preferably comprise fibrils intertwined one with the next for enhanced preform strength. The second of the interpenetrating regions comprises about 1% to about 40% by volume of the MMC and is devoid of any filler particles, i.e., is "particle-free". The second, or particle-free, region pervades the composite in the form of a three-dimensional, open-cell reticulum of randomly oriented ligaments interconnecting a plurality of nodes and defining a plurality of interconnected interstitial cells which vary in size from about 50 microns to about 10,000 microns. The first, or particle-rich, region fills the interstitial cells defined by the second, or particle-free, region. Overall, the MMC will comprise about 2% to about 70% by volume of the particles. When fibrilous particles are used, loadings of ca. 30%–40% by volume, maximum, are used. The fibrils will have lengths varying between about 1 micron and about 500 microns, have diameters less than about 10 microns, and have aspect ratios (i.e., length/diameter) varying between about 3 and about 50 depending on the composition of the particular filler particle being used. Filler particles particularly useful with the present invention include carbon/graphite, alumina, glass, mica, silicon carbide, silicon nitride, wollastonite, potassium titanate fiber, aluminosilicate (e.g., Kaowool), zirconia, and yttria.

The preform comprises a porous, heterogeneous mass of discrete filler particles comprising about 2% to about 70% by volume of the preform. The particles may or may not be bonded to each other depending on the particular fillers being used and the amount thereof. In this regard, if the preform is sufficiently durable and self-supporting without separate interparticle bonding, no such bonding is needed. The particle mass is pervaded with a three-dimensionally, reticulated, particle-free network. In a preferred embodiment, the particle-free network initially comprises a plurality of randomly oriented, fugitive polymeric ligaments interconnecting a plurality of nodes dispersed throughout the particle mass (i.e., a polymeric foam). Prior to filling the preform with metal, the polymer is volatized or burned-off leaving a network of capillaries in its stead conforming to the shape of the original polymeric foam. In another embodiment, the particle-free reticulated network comprises a plurality of randomly oriented metal ligaments interconnecting a plurality of nodes dispersed throughout the particle mass (i.e., a metal foam). The metal foam is not removed and remains with the preform as well as the MMC made therefrom.

One method of making the preform and MMC of the present invention is described in copending United States patent application Sokol et al., U.S. Ser. No. 08/314,738 filed concurrently herewith and assigned to the assignee of the present invention. U.S. Ser. No. 08/314,738 involves providing a fugitive, open-cell, polymeric foam substrate (e.g., polyurethane or silicone foam) comprising a plurality of ligaments interconnected by a plurality of nodes which together form a three-dimensional reticulum defining a multitude of interstitial cells varying in size from about 50 microns to about 5000 microns (preferably about 100 microns to about 2000 microns). The foam substrate is molded, machined, or otherwise shaped, to the desired shape it is to have in the finished MMC article. The foam substrate is then impregnated with a slurry of the filler particles suspended in a fugitive vehicle, such as water, having a dispersing agent therein. The concentration of particles in the slurry will depend on the nature of the particles, the vehicle and the size of the cells in the substrate. For aqueous slurries, the particle concentration will generally be about 5% by volume to about 80% by volume particles. The interstitial cells of the foam substrate are filled with about 5% to about 90% by volume particles so that, upon removal of the water, about 30% to about 95% by volume void space remains in the cells, between the particles, for subsequently filling with metal.

A preferred polymeric foam substrate comprises a polyurethane foam formed by the reaction between a polyol and a polyisocyanate which reaction generates $CO_2$ bubbles in the reaction mass, which in turn acts as a blowing agent to foam the polyurethane into a plethora of cells varying in size from about 50 microns to about 5000 microns, and preferably about 100 microns to about 2000 microns. Foamed substrates having cells in the preferred range are not only easy to manufacture and infiltrate, but provide macro-scale homogeneity and strength. Other polymeric foams, e.g., silicone foams, may also be used.

To fill the foam, the particles are preferably suspended in water having a dispersant (e.g., ammonium polyacrylate) therein, and the foam substrate impregnated by positioning the substrate contiguous with a porous filter material, e.g., sintered glass frit or fine screen. Drawing a vacuum from the backside of the filter material while feeding the slurry into the substrate positioned on the front side of the filter sucks the water through the filter, while leaving the particles trapped in the interstitial cells/pores of the foam. Alternatively, the foam substrate may be placed at the bottom of a suitable vessel filled with the aqueous slurry and left there long enough for the particles to settle out of the slurry and into the interstitial pores/cells by a sedimentation process. Removal of air from the foam as well as evaporation of the water from the slurry facilitates the filling process. When fibrils are used, their length will preferably be about 5 to about 10 times smaller than the cell size of the foam to facilitate impregnation and avoid their matting up on the surface of the foam.

Following particle impregnation of the foam, the liquid vehicle used to carry the particles into the interstitial cells of the substrate is removed by heating the particle-filled foam to dryness. The foam substrate helps retain the shape of the preform during drying. Once the fibrils are dry, the preform is self-supporting and readily handleable as the caking of the fibrils within the foam provides significant green strength thereto.

Next (e.g., just prior to filling with metal), the particle-filled substrate is heated sufficiently to volatize or burn-off the foam substrate as well as the dispersant and leave in its stead a three-dimensional, reticulated network of interconnected, particle-free capillaries pervading the mass of particles and conforming to the structure of the foam substrate that was removed. In the case of polyurethane foam substrates, burning-off can be effected by heating the particle mass to a temperature of about 1000° C. in air. The volatiles escape the particle mass through the voids therein, and in view of the low volume of organics being burned-off, removal is easier, quicker and more environmentally friendly than preforms formed by injection molding with organic binders. In many cases, the resulting product has sufficient green strength for handling without any additional treatment. This is especially true with high loadings of fibrils. However, optionally and for added security (especially when low loadings, ca. 15% by volume or less, or equiaxed particles are used), the particles may be further bonded together (i.e., more than naturally results from the caking of the particles during filling) without significant densification thereof. By limiting densification, the void volume between the particles remains open to subsequent infiltration and filling by the matrix metal. Bonding of the particles may be accomplished by simply heating the mass to a temperature sufficient to sinter the particles to each other, or by means of a small amount of binder on the surface of the particles which serves to tack the particles together. For example, when $Al_2O_3$ fibrils are used, sintering is achieved by heating the particles to at least 1300° C. and preferably to about 1500° C. in air for about 60 minutes. Alternatively, colloidal silica or silica gel coatings may be provided on the surfaces of the particles which will, at elevated temperatures (i.e., about 800° C.), soften and act like a glue to hold the particles together, as is well known in the art. Silica on the surface of the particles also serves to promote bonding of the particles to aluminum matrix metals. The aforesaid prefoam-making process permits easier net shape preform production, and significantly shortens the time required to remove the vehicle from the particles as well as the organics from the preform.

To complete the making of the MMC product, the void spaces between the several particles in the particle-rich region as well as the capillaries left by the destruction of the foam substrate in the particle-free region are infiltrated with molten metal. Conventional techniques, such as wicking or pressure filling (e.g., die-casting or squeeze-casting) may be used with the latter being preferred. Quite advantageously, the particle-free capillary network that pervades the particle mass facilitates the filling of the mass by providing unobstructed inroads thereinto. Preheating the preform to about 200° to 800° C. facilitates impregnation thereof with molten metal.

Another preform, and corresponding MMC, according to the present invention utilizes an open-cell metal foam as the substrate to be filled with the particles. In this embodiment, the metal foam substrate will not be removed from the preform, but rather remains therewith during metal filling and becomes an integral part of the finished MMC product. More specifically, a metal foam substrate is used which comprises a plurality of randomly oriented ligaments interconnected by a plurality of nodes which together form a three-dimensional reticulum defining a multitude of interstitial cells. The metal foam substrate may comprise the same, essentially the same (i.e., alloys of), or an entirely different metal than the matrix metal embedding the particles, depending on the needs of the MMC product being produced. Hence, for example, the matrix metal may comprise aluminum or magnesium, while the foam substrate metal might comprise aluminum, magnesium, nickel, iron, copper, etc. One metal foam, useful in the present invention, is formed by electrodepositing a layer of metal onto a fugitive foam substrate (i.e., polyurethane) such as described in Katz U.S. Pat. No. et al 3,694,325 assigned to the assignee of this invention. The fugitive foam is then burned-off leaving a hollow metal network. Another metal foam useful with the present invention may be formed by depositing metal particles onto a fugitive substrate such as used by Katz et al, and then sintering the particles together while concurrently removing the substrate. Still other foams made by directional solidification may be used. One such directionally solidified aluminum foam, for example, is sold under the trade name DUOCELL® by the ERG Materials and Aerospace Corporation has been used effectively.

The open-cell, metallic reticulum is impregnated with a slurry of filler particles suspended in a fugitive vehicle. The vehicle used to carry the particles into the metal foam substrate may comprise any of a variety of fluids including organics such as wax, polystyrene, polyethylene, methyl cellulose/$H_2O$ gel, etc., or simply water, as described above for filling the polymeric foam. While an aqueous sedimentation process, as discussed above, may be used with metal foam, preferably the particles will be thoroughly mixed with an organic binder and injected under pressure into a mold containing the substrate. One such binder comprises eighty (80) weight percent diphenyl carbonate and twenty (20) weight percent polystyrene. After pre-blending at 120° C., the binder is mixed with the desired fiber or particulate volume fraction by using a roller blade mixer, a sigma blade mixer or twin-screw extruder. The feedstock is then extruded and pelletized for introduction into the injection molding machine. The metallic foam is inserted into a die of the same or other shape, and the feedstock is melted by the action of the molding screw and injected into the die under pressure, infiltrating the interconnected pores of the foam from the gate to the end-of-fill. The foam aids in the reduction of shrink-related voids by serving as already-dense filler. The use of injection molding to infiltrate reinforcement is not limited to metal networks, but may also be used with relatively rigid polymer foams as well. Flexible foams tend to be compacted by the plastic against die wall opposite the gate.

Use of warmer barrel and die temperatures and modestly increased injection pressures over those that might be used if the metallic network were not present is helpful as an aid to infiltration of the foam. Pre-heating the foam to or above the die temperature also aids infiltration.

Following impregnation of the porous substrate with the slurry, the vehicle is removed so as to leave the filler particles entrained within the interstitial cells/pores of the metal foam substrate. In the case of organic/polymeric vehicles, removal is preferably effected by heating the particle-filled foam sufficiently to volatize or burn-off the vehicle. With the metal foam substrate present, this burn-off can be achieved more quickly than if there were no such substrate present and without fear of distorting the preform. Alternatively, the organic vehicle may be removed by dissolution in an appropriate solvent. A combination of solvent and heat removal has been demonstrated for vehicles comprising a mixture of two or more organic ingredients. For the polymeric binder discussed above, the diphenyl carbonate portion is removed by dissolution in warm methanol and the remaining polymer removed by thermal treatment to 600° C. For aluminum foams, which are low-melting and easily-oxidized, the heat-treatment can be done in a non-oxidizing atmosphere (Ar, $N_2$) to 450° C. Aqueous vehicles are most simply removed by heating to drive off the water and dry the particle-filled metal foam. Metal foam substrates having cell/pore sizes between about 500 microns and 2000 microns permit particle loadings up to about 15% by volume to about 70% by volume respectively with a maximum of about 45% by volume when the particles are fibrils having aspect ratios greater than about 10.

Following removal of the vehicle, the particles may or may not be further bonded together as by sintering or $SiO_2/Al_2O_3$-gluing as discussed above for the fugitive foam substrate. In this regard, since the metal foam survives and continues to support the particles, the metal foam alone is sufficient to provide exceptional green strength to the preform for handling without the need for a separate bonding (e.g., sintering, $SiO_2$ gluing, etc.) operation—though it may optionally be provided. An alternative technique for bonding the particles together is to leave a small amount of the vehicle in place to act as a binder. This is particularly effective when the vehicle is a thermoplastic material. Finally, the particle-filled metal foam is filled with molten metal using conventional wicking or pressure filling techniques, as discussed above. When the matrix metal used to fill the preform is the same composition as the metal used to make the foam substrate, the metal in the foam tends to melt, at least on its surface, and weld with the matrix metal being introduced into the particle bed. When the metal foam and the matrix metal are dissimilar, some alloying/diffusion bonding may occur at the interfaces therebetween. Preheating of the preform to about 200° to 800° C. facilitates impregnation therewith molten aluminum.

THE FIGURES AND EXAMPLES

FIG. 1 is a draftsman's illustration of a preferred three-dimensional, open-cell, foam, reticulum of the type used as a substrate in the formation of preforms according to the present invention, and may comprise either a metal or a fugitive organic material as discussed above. The reticulum 2 comprises a plurality of ligaments 4 joined to each other via a plurality of nodes 6, and together therewith defining a plurality of interconnected, interstitial pores/cells 8.

Figure 2:
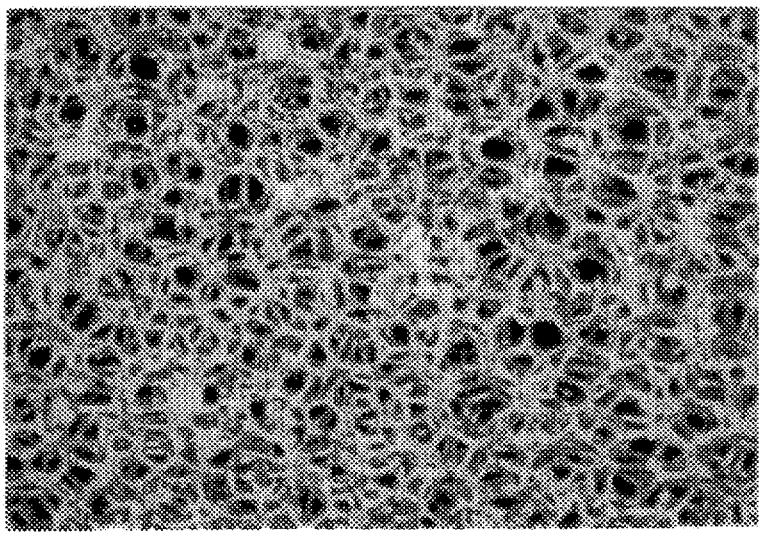
FIG. 2 is a photomicrograph of a metal foam substrate.

FIG. 2 is a photomicrograph of an actual sample of a metal foam substrate such as is illustrated in FIG. 1.

Example 1

Figure 3:
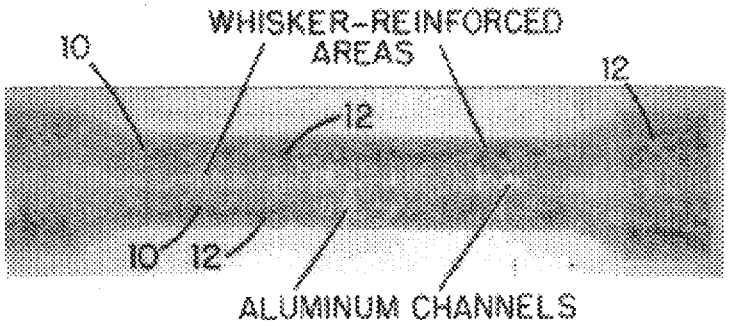
FIGS. 3, 4 and 5 are photomicrographs of certain MMC test samples.

A ½ inch thick block of DUOCELL®, open-cell, A356 aluminum foam shown in FIG. 2 having cell/pore sizes ranging in from about 500 microns to about 4000 microns (average about 2000 microns) was infiltrated with an aqueous slurry of aluminum oxide whiskers formed in a high speed blender. The slurry contained 100 grams whiskers, 600 grams water, and 0.6 grams of ammonium polyacrylate as a dispersant sold by R. T. Vanderbilt Co. under the trade name Darvan 821A. The whiskers had an average length of about 50 microns, an average diameter of about 3 microns, and an average aspect ratio of 20. The whisker dispersion was poured into the A356 aluminum foam which was situated in a water-impervious mold. Infiltration of the whisker into the open channel of the aluminum foam was assisted by low-frequency vibration (about 200 Hz). Infiltration continued until the interstitial cells of the foam were loaded with about 15% by volume whiskers. The thusly impregnated aluminum foam was then dried by heating at a rate of 10° C./min to 500° C. and held there for 1 hour. The metal foam was then ready for filling with molten aluminum. The metal foam was placed in a die having a zinc stearate coating (i.e., to facilitate removal of filled foam), heated to about 400° C. in Argon, and impregnated with molten 206 aluminum in a die preheated to 256° C. The 206 aluminum metal temperature was 850° C., and had a pressure of 6 ksi applied thereto for 2 minutes. The resultant product is shown in FIG. 3. The lighter areas 10 show the original aluminum foam substrate. The darker areas 12 show the whisker-filled aluminum regions in the interstitial cells of the foam substrate 10. Tensile bars of this material, heat-treated to the T-71 condition for the 206 alloy, had an average tensile strength of 43 ksi. The average cycles to failure, at R=−1 and 18 ksi at 50 Hz was 31,000.

Example 2

Figure 4:
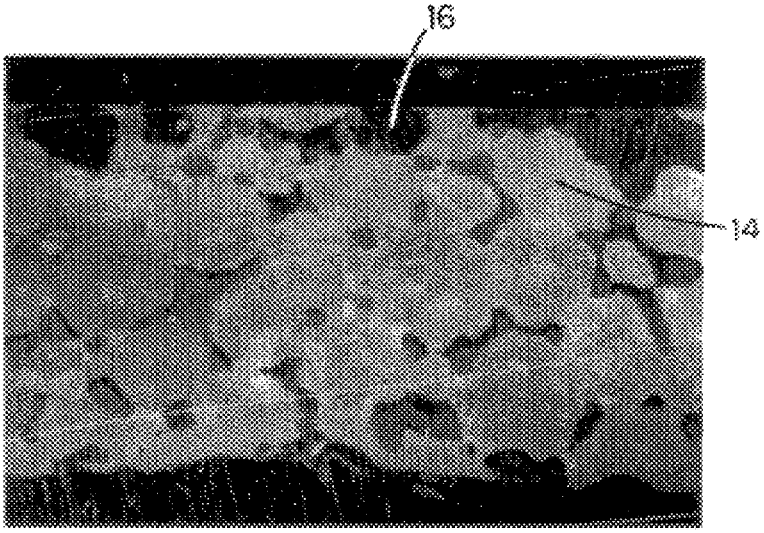

A block of 356 aluminum alloy sponge having a structure like that used in Example 1 (but a pore size of 10 pores per lineal inch) was infiltrated by injecting a mixture of 80 weight percent diphenyl carbonate and 20 weight percent polystyrene containing 30 volume percent of Saffil aluminosilicate whiskers. The whiskers varied in length from about 10 microns to about 100 microns and had diameters between about 2.8 microns to about 3.2 microns. An injector barrel temperature of 68° C. and a die temperature of 30° C. was used. The preform was placed in the heated die long enough to come up to die temperature. An injection pressure (i.e., at the injector nozzle) of 3,000 psi was used to fill the die followed by increasing the pressure to pack more mix into the die as cooling occurs to accommodate shrinkage. The packing pressure profile was as follows: (1) 3,000 psi for 2.0 sec.; (2) 4,500 psi for 4.0 sec.; and (3) 6,000 psi for 20.0 sec. Thereafter, the diphenyl carbonate was extracted by soaking the block in a 4:1 methanol/acetonitrile mixture for 113 hours. The remaining polystyrene was removed by heating in nitrogen as follows: (1) from room temperature to 50° C. at a rate of 1° C./min.; (2) from 50° C. to 100° C. at a rate of 0.5°/min.; (3) from 100° C. to 450° C. at a rate of 0.8°/min.; and (4) hold at 450° C. for 4 hours. The resulting preform was then preheated to a temperature 500° C. in $N_2$ and filled with 206 aluminum alloy containing an additional 2% magnesium, utilizing a squeeze-casting process wherein the aluminum melt was at a temperature of 800° C., the die temperature was 256° C., and applied pressure was 6,000 psi. FIG. 4 shows a low magnification image of the resulting product, and reveals that the cellular nature of the original metal foam substrate 14 is preserved and is embedded in particle-filled matrix metal 16. Test samples yielded the properties shown in the following table.

| | Sample #1 | Sample #2 |
|---|---|---|
| Temperature | 75° F. | 75° F. |
| Ultimate Load (lbs) | 1630 | 1720 |
| Tensile Strength (psi) | 32681 | 34486 |
| .2 Yld. Strength (psi) | (7) | (7) |
| Modulus (msi) | 23.4 | 26.6 |
| Elongation (%) | .17(1) | .16 |
| Orig. Diameter (in) | .252 | .252 |
| Orig. Area ($in^2$) | .049876 | .049876 |
| Final Diameter | — | — |
| Final Area | — | — |

Fatigue samples run at 50 Hz, R=−1 and 18,000 psi lasted 56,500 and 13,110 cycles. This aluminum foam/aluminum MMC composite was tested for wear-resistance under microwelding conditions by a test designed to simulate piston ring and ring groove wear. In this 50 Hz reciprocating, sliding test, a 3000 psi Hertzian contact stress is applied between the sample and a phosphated nodular iron ring section. Only one drop of oil is applied, and its effectiveness is gradually reduced and eliminated by heating the assembly to 225°, 240°, 265° C., etc., until an increase in the friction and a decrease in electrical resistance of the interface are measured, indicating the onset of microwelding. The aluminum foam composite resisted microwelding up until a temperature of 265° C. was reached and hence performed as well as a fully-reinforced (100% MMC) aluminum composite.

Example 3

A ceramic powder slurry was prepared by mixing 100 grams of submicron-sized $Si_3N_4$ particles with 50 grams of water using 0.5 grams of ammonium polyacrylate (Darvan 821 A) as a dispersant. The mixture was sonically vibrated at a frequency of 200 Hz for 1 min. to assist powder dispersion. The slurry was then poured onto an open-cell, polyurethane foam sponge which was situated in a water-impervious mold. The open cells of the sponge varied from about 20 to about 5,000 μm in diameter, and its ligaments varied in cross section from about 20 to about 100 μm. Infiltration of the powder slurry into the sponge was assisted by applying a vacuum to remove air from the foam. The particles settled into the sponge as a combined consequence of the sedimentation of particles due to gravity and the evaporation of water. The thusly-filled foam was removed from the mold and heated at a rate of 10° C./min. to 1000° C. in air for 60 minutes to burn-out the foam and to slightly strengthen the particle mass. The resulting preform was self-supporting and readily handleable. This sample was never infiltrated.

Example 4

A ceramic whisker slurry was prepared in a high-speed blender by stirring 100 grams of $Al_2O_3$ whiskers with 0.6 grams of Darvan 821 A dispersant and 700 grams of water. The whiskers had a diameter range of 0.5 to 3 micrometers and a length range of 5 to 100 micrometers. The slurry was poured into an open-cell, three-dimensionally reticulated steel foam situated in a water-impervious mold. The ligaments of the cellular steel foam had cross sections ranging from 100 to 3,000 micrometers and its open cells ranged from 100 to 10,000 microns in diameter. Low-frequency vibration (about 200 Hz) was applied to the mold to assist infiltration of the whiskers into the foam as the whiskers settled out and the water evaporated.

The particle-filled steel matrix was removed from the mold and heated at a rate of 10° C./min. to 500° C. to remove the water. The resulting preform was then placed in a mold and molten 206+2% Mg aluminum squeeze-cast thereinto using a pressure of 6,000 psi, a casting temperature of 818° C. and a mold temperature of 223° C. The resulting MMC has an ultimate average tensile strength of 24.3 ksi and average elongation to failure of 0.35%.

Example 5

A whisker slurry prepared as described in Example 2 was poured onto an open-cell, three-dimensionally reticulated DUOCELL® 356 aluminum foam situated in a water-impervious mold. The aluminum foam had cells in the range of 300 to 5,000 microns, and ligament cross sections ranging from 200 to 1,000 microns. The whiskers filled about 25% by volume of the foam's interstitial cells. The foam was then filled with aluminum (i.e., 206 Al+2% Mg).

Example 6

The whisker slurry prepared as described in Example 2 was poured onto a polyurethane sponge situated in a water-impervious mold. The sponge had a three-dimensional reticulated structure wherein the cross sections of the ligaments varied from 20 to 100 microns, while the open cells therebetween had diameters ranging from 30 to 5,000 microns. While immersed in the slurry, the sponge was manually squeezed and compressed to drive out any air bubbles trapped therein. When released, the deformed sponge returned to its original shape while drawing the slurry thereinto and then allowed to stand and fill by sedimentation. Following filling and drying, the green preform was removed from the mold and heated to 1000° C. (10° C./min.) to burn-out the sponge and strengthen the particle mass. The resulting preform was self-supporting and readily handleable.

Example 7

Figure 5:
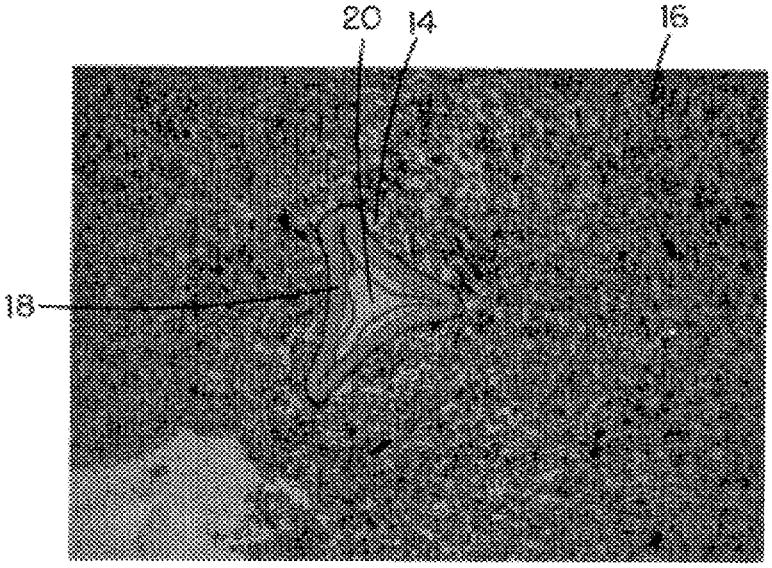

An Fe foam similar to the steel foam described in Example 4 was heated to a temperature of 93° C. and infiltrated via injection molding using the same composition as in Example 2. An injector barrel temperature of 71° C. and a die temperature of 45° C. were used. At 5,000 psi pressure, the die took 8.9 seconds to fill, which was followed by packing pressures of: (1) 5,000 psi for 2 sec.; (2) 6,500 psi for 4 sec.; and (3) 8,000 psi for 20 sec.; to accommodate shrinkage during cooling. All of the changes made with respect to Example 2, facilitated the filling of the foam. The polymer was removed using the method outlined in Example 2. The preform was placed in a die and infiltrated with molten 206+2% Mg aluminum alloy at 799° C. The die temperature was 238° C. The Fe foam was made according to U.S. Pat. No. 3,694,325 and consists of hollow iron ligaments 18 (see hollow cavity 20) which were infiltrated with aluminum alloy during the squeeze casting, as shown in FIG. 5. The resulting MMC material had an average ultimate tensile strength of 21 ksi and a total elongation of 0.23%.

While the invention has been disclosed primarily in terms of certain specific embodiments thereof it is not intended to be limited thereto but rather only to the extent set forth hereafter in the claims which follow.

The embodiments of the invention in which an exclusive property or privilege is claimed is defined as follows:

1. A metal matrix composite comprising about 2% to about 70% by volume filler particles and the balance metal, said composite being characterized by discrete particle-rich first and particle-free second interpenetrating regions, said particle-rich first region constituting about 60% to about 99% by volume of said composite and comprising a first metal embedding a multiplicity of discrete filler particles wherein said particles constitute about 5% to about 70% by volume of said first region, and said particle-free second region comprising a second metal and constituting about 1% to about 40% by volume of said composite said second region pervading said first region in the form of a three dimensional open-cell reticulum comprising a plurality of randomly oriented ligaments interconnecting a plurality of nodes and defining a plurality of interconnected interstitial cells which vary in size from about 50μ to about 10,000μ, said cells being filled with said first region.

2. A metal matrix composite according to claim 1 wherein said particles are fibrils having an aspect ratio of between about 3 and about 50.

3. A metal matrix composite according to claim 1 wherein said particles in said first region are bonded to each other independently of said first metal embedding said particles.

4. A metal matrix composite according to claim 1 wherein said particles are selected from the group consisting of alumina, aluminosilicate, silicon carbide, silicon nitride, potassium titanate fiber, zirconia, and yttria.

5. A metal matrix composite according to claim 2 wherein said fibrils vary in length between about 1 and about 500 microns and have diameters less than about 10 microns.

6. A metal matrix composite according to claim 1 wherein said second metal is compositionally different from said first metal.

7. A metal matrix composite according to claim 6 wherein said first and second metals comprise different alloys of the same basic metal.

8. A metal matrix composite according to claim 4 wherein said first metal is selected from the group consisting of magnesium and aluminum.

* * * * *